US007850298B2

(12) United States Patent
Ono et al.

(10) Patent No.: US 7,850,298 B2
(45) Date of Patent: Dec. 14, 2010

(54) IMAGE FORMING APPARATUS

(75) Inventors: Akehiro Ono, Nagoya (JP); Masahiro Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1042 days.

(21) Appl. No.: 11/411,958

(22) Filed: Apr. 27, 2006

(65) Prior Publication Data

US 2006/0244804 A1 Nov. 2, 2006

(30) Foreign Application Priority Data

Apr. 27, 2005 (JP) ..... 2005-129937

(51) Int. Cl.
*B41J 2/01* (2006.01)

(52) U.S. Cl. ..... 347/104; 347/139; 361/212; 361/221; 101/229

(58) Field of Classification Search ..... None
See application file for complete search history.

(56) References Cited

U.S. PATENT DOCUMENTS

| | | | | | |
|---|---|---|---|---|---|
| 4,307,432 | A | * | 12/1981 | Nishikawa | 361/221 |
| 4,741,524 | A | * | 5/1988 | Bromage | 271/208 |
| 5,326,179 | A | * | 7/1994 | Fukai et al. | 400/521 |
| 5,710,692 | A | * | 1/1998 | Muck et al. | 361/212 |
| 2005/0047842 | A1 | | 3/2005 | Nobe | |
| 2005/0232672 | A1 | * | 10/2005 | Nakamura et al. | 399/405 |

FOREIGN PATENT DOCUMENTS

| | | | |
|---|---|---|---|
| JP | UM A 57-155147 | * | 9/1982 |
| JP | 4323166 | A | 11/1992 |
| JP | 8059050 | A | 3/1996 |
| JP | 9058915 | A | 3/1997 |
| JP | 2002046920 | A | 2/2002 |
| JP | 2004115254 | A | 4/2004 |
| JP | 2005075606 | A | 3/2005 |

OTHER PUBLICATIONS

Website: Amazon.com, Dated Aug. 17, 2009, Screen Shot at http://www.amazon.com/Xerox-Docuprint-Network-Laser-45ppm/dp/B000067SHE.*

JP 2004-115254 A—English (Machine) Translation of JP 2004-115254, http://dossier1.ipdl.inpit.go.jp/AIPN/aipn_call_transl.ipdl?—Translated Feb. 17, 2010.*

* cited by examiner

*Primary Examiner*—Matthew Luu
*Assistant Examiner*—John P Zimmermann
(74) *Attorney, Agent, or Firm*—Baker Botts LL.P.

(57) ABSTRACT

An image forming apparatus that includes a discharge tray on which a sheet discharged from a discharge port is stacked; a sheet retainer, which guides the sheet discharged from the discharge port onto the discharge tray and is displaced in abutment against an uppermost sheet stacked on the discharge tray, the sheet retainer removing electricity of the sheet; and a detection unit, which detects a stack of the sheet on the discharge tray on a basis of a position of the sheet retainer.

7 Claims, 5 Drawing Sheets

IMAGE FORMING APPARATUS

CROSS REFERENCE TO RELATED APPLICATION

This application claims priority from Japanese Patent Application No. 2005-129937, filed Apr. 27, 2005, the contents of which are hereby incorporated by reference into the present application.

TECHNICAL FIELD

Aspects of the present invention relate to an image forming apparatus.

BACKGROUND

In an image forming apparatus such as a laser printer, a paper sheet comes, while being conveyed in the apparatus, into sliding contact with the individual portions of a conveying passage so that electric charges become liable to be stored in the paper sheet. When the paper sheet thus charged is discharged onto a discharge tray, an attraction is generated by an electrostatic force between the discharge tray and the paper sheet having been discharged, thereby causing a stacking failure. In JP-A-2005-75606, the stacking failure is prevented by arranging an electricity removing brush at the discharge port of the paper sheet thereby to remove electricity from the paper sheet discharged to the discharge tray.

On the other hand, an image forming apparatus is equipped with a holding member for guiding the paper sheet discharged from the discharge port, onto the discharge tray thereby to improve the stackability of the paper sheets. Another known image forming apparatus is equipped with a detection member, which is displaced when it abuts against an uppermost paper sheet stacked on the discharge tray, thereby to detect the stack of the paper sheets.

In the image forming apparatus of the related art, the electricity removing brush, the holding member and the detection member are disposed independently of one another. This raises problems, such an increase in the number of parts and an accompanying rise in the cost.

SUMMARY

Aspects of the present invention provide an image forming apparatus for reducing the parts number thereby to lower the cost.

According to an illustrative example, an image forming apparatus includes: a discharge tray on which a sheet discharged from a discharge port is stacked; a sheet retainer, which guides the sheet discharged from the discharge port onto the discharge tray and is displaced in abutment against an uppermost sheet stacked on the discharge tray, the sheet retainer removing electricity of the sheet; and a detection unit, which detects a stack of the sheet on the discharge tray on a basis of a position of the sheet retainer.

According to an example structure, the sheet retainer is provided with the three functions: the function to guide the sheet onto the discharge tray thereby to enhance the stackability; the function as the detection member to detect the stack of the sheet; and the function to remove electricity from the sheet. As a result, the number of parts can be reduced to lower the cost.

DETAILED DESCRIPTION OF ILLUSTRATIVE EXAMPLES

<First Illustrative Aspect>

A first illustrative aspect of the invention is described with reference to FIG. 1 to FIG. 4.

(Entire Constitution of Laser Printer)

Figure 1:
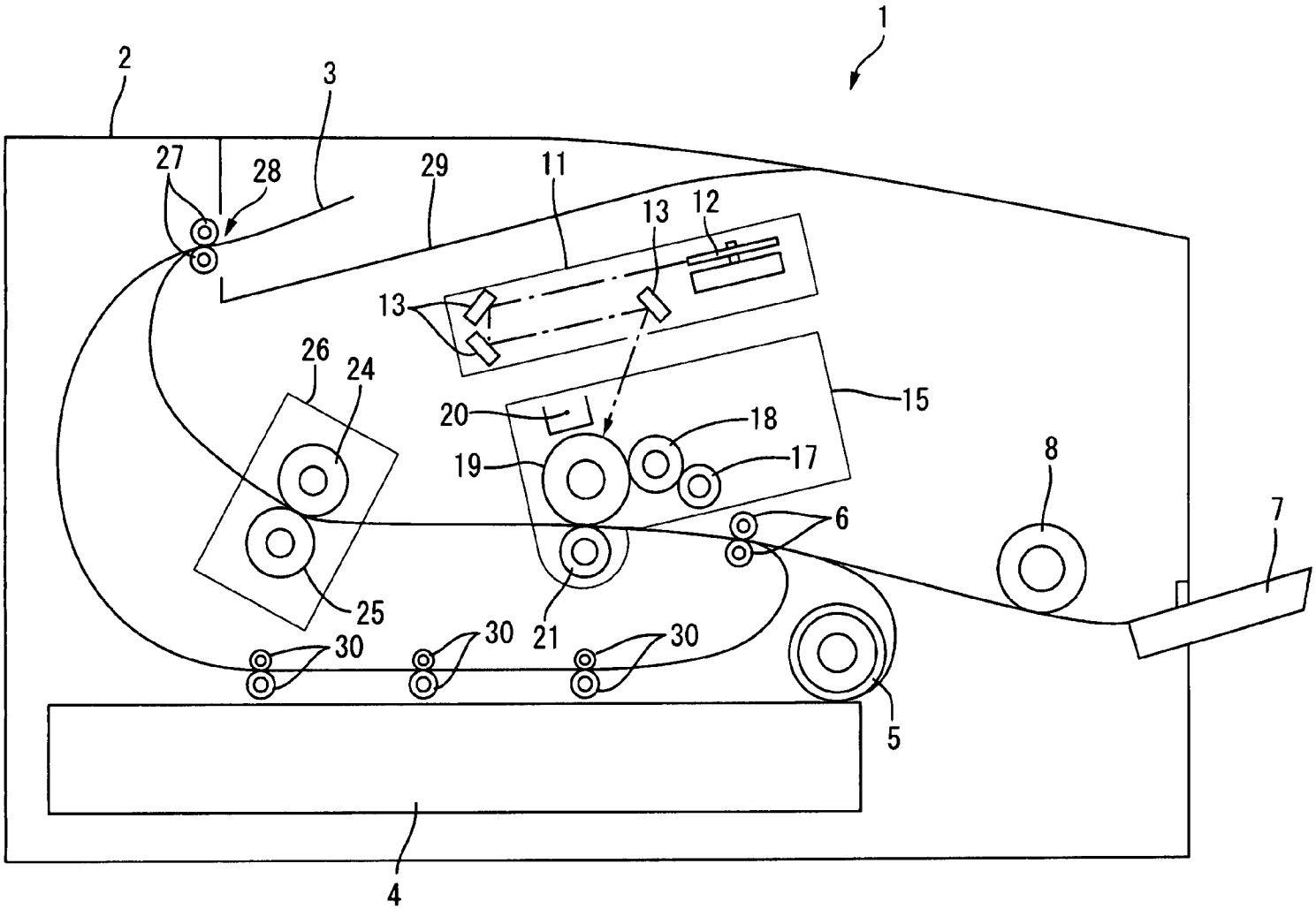
FIG. 1 is a sectional side view showing a schematic constitution of a laser printer according to a first illustrative aspect of the invention.

FIG. 1 is a sectional side view showing a schematic constitution of a laser printer as an image forming apparatus of the invention. Here, the right side in FIG. 1 is taken in the front in the following description.

A laser printer 1 is equipped with a generally box-shaped body casing 2. In the bottom portion of the body casing 2, a feed tray 4 to be loaded with sheets of paper 3 for forming images is so mounted as can be extracted forward. Above the front end of the feed tray 4, there is disposed a feed roller 5. When rotated, the feed roller 5 feeds the paper sheet 3 laid at the uppermost position in the feed tray 4 to a resist roller 6 disposed above the back side of the feed roller 5. On the front face of the body casing 2, on the other hand, there is disposed a manual tray 7, from which the paper sheet 3 is fed to the resist roller 6 as a manual feed roller 8 rotates. The resist roller 6 resists the paper sheet 3 and then conveys it to between a photosensitive drum 19 and a transfer roller 21.

At an upper portion in the body casing 2, there is disposed a scanner unit 11 acting as exposure means. This scanner unit 11 is equipped with a (not-shown) laser beam emitting unit, a polygon mirror 12, a plurality of reflecting mirrors 13, a plurality of (not-shown) lenses and so on. The scanner unit 11 irradiates the surface of the photosensitive drum 19 with the laser beam emitted from the laser beam emitting unit, through the polygon mirror 12, the reflecting mirrors and the lenses.

Below the scanner unit 11, a process cartridge 15 is loaded so as to be made removable with respect to the body casing 2. This process cartridge 15 is provided with a (not-shown) toner containing chamber for containing toner as a developing agent, a feed roller 17, a developing roller 18 acting as developing means, the photosensitive drum 19 acting as an image carrier, a scorotron type charger 20, the transfer roller 21 acting as transfer means, and so on.

The toner is fed, as discharged from the toner containing chamber, to the developing roller 18 by the feed roller 17, so that the toner is frictionally charged to the positive polarity between the feed roller 17 and the developing roller 18. In accordance with the rotation of the photosensitive drum 19, the surface of the photosensitive drum 19 is charged first homogeneously to the positive polarity by the scorotron type charger 20 and is then exposed to a laser beam L coming from the scanner unit 11, thereby to form an electrostatic latent image corresponding to the image to be formed on the paper sheet 3. As the developing roller 18 rotates, the toner on the developing roller 18 is then fed to the surface of the photosensitive drum 19 so that the electrostatic latent image is visualized. After this, the toner image carried on the surface of the photosensitive drum 19 is transferred to the paper sheet 3 by a transfer bias voltage applied to the transfer roller 21, while the paper sheet 3 is passing between the photosensitive drum 19 and the transfer roller 21.

On the back of the process cartridge 15, there is disposed a fixer 26 which is equipped with a heating roller 24, a pressure roller 25 and so on. This fixer 26 fixes the toner image transferred to the paper sheet 3, thermally on the paper surface. The paper sheet 3 thermally fixed is conveyed to a discharge roller pair 27 disposed above the body casing 2. The discharge roller pair 27 forms a discharge port 28, through which the paper sheet 3 is discharged, as the discharge roller pair 27 rotates, onto a discharge tray 29 disposed in the upper face of the body casing 2. At a double-side printing time, the paper sheet 3 having an image formed on one side is conveyed to the discharge roller pair 27. After this, the discharge roller pair 27 is turned while clamping the paper sheet 3 so that the paper sheet 3 is sent from the trailing end side to resending rollers 30 disposed at a lower portion in the body casing 2. The paper sheet 3 is resent by the resending rollers 30 to the resist roller so that the image is subsequently formed again on the back of the paper sheet 3. After this, the paper sheet 3 is discharged onto the discharge tray 29 by the discharge roller pair 27.

(Constitution Around Discharge port)

Figure 2:
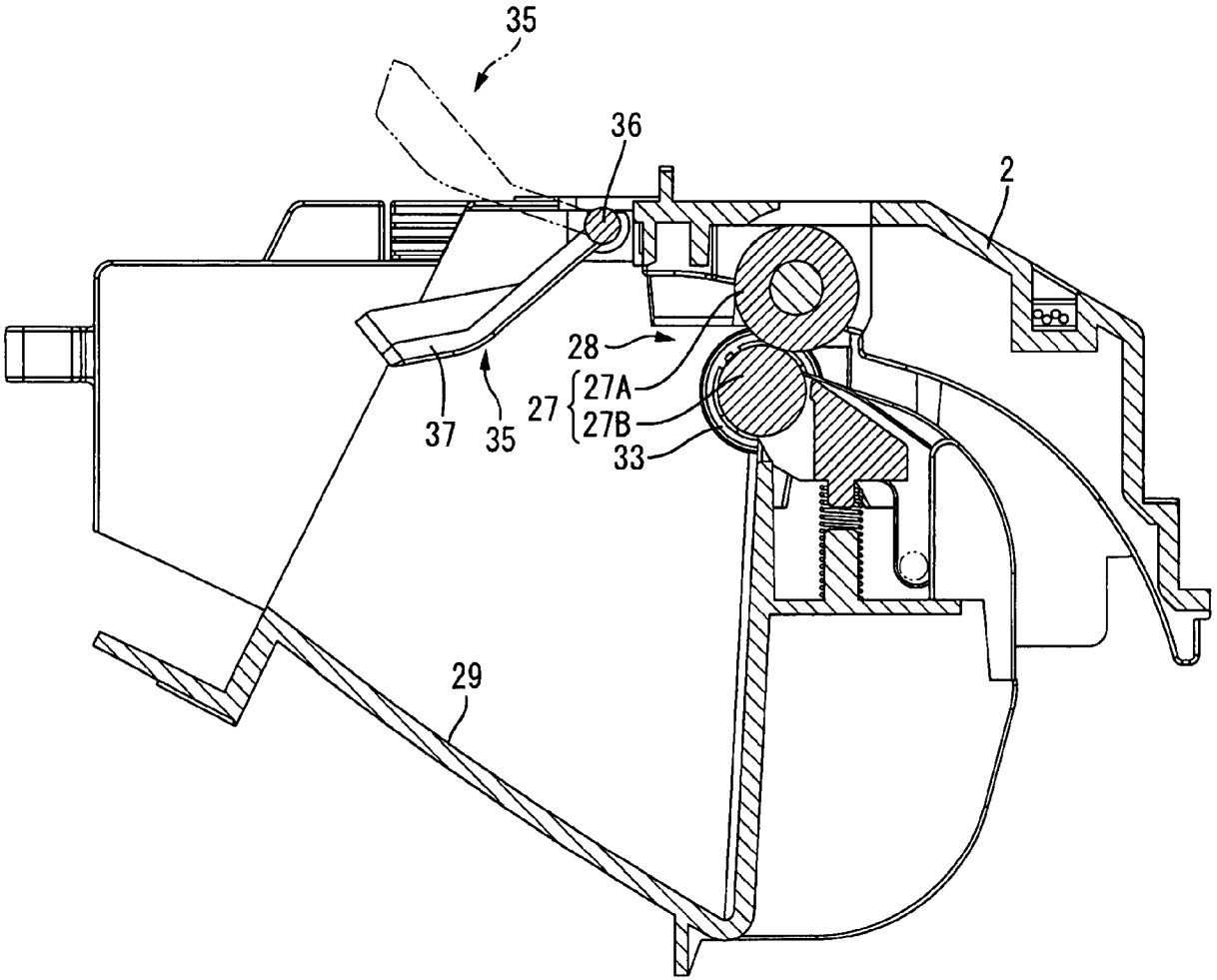
FIG. 2 is an enlarged sectional side view of a portion around a discharge port.
Figure 3:
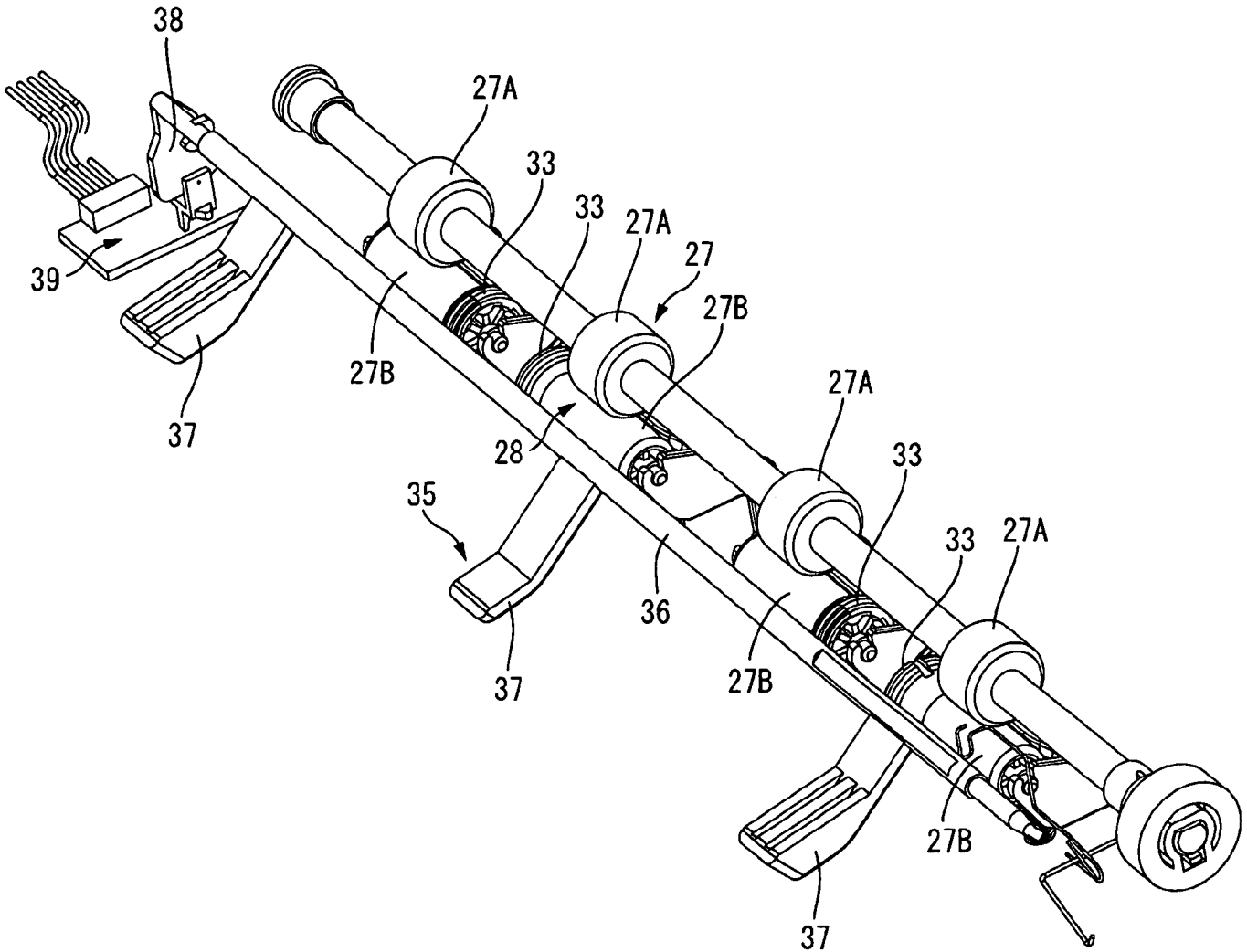
FIG. 3 is a perspective view showing members taken out of the portion around the discharge port.
Figure 4:
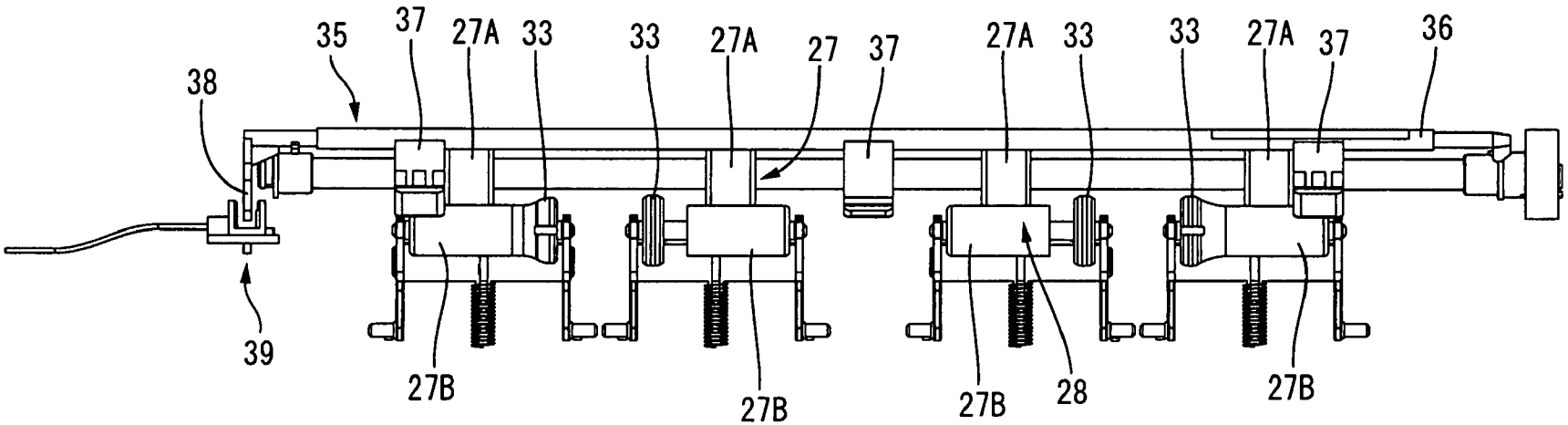
FIG. 4 is a front view showing the members of the portion around the discharge port.

FIG. 2 is an enlarged sectional side view of a portion around the discharge port; FIG. 3 is a perspective view showing members taken out of that portion; and FIG. 4 is a front view of the members. In FIG. 2, the left side is taken in the front.

The discharge roller pair 27 is composed of four drive rollers 27A, which are rotationally driven by a driving power coming from the not-shown motor, and four driven rollers 27B which follow the drive rollers 27A individually to rotate therewith. Each driven roller 27B is equipped at one end portion with a corrugated roller 33 radially bulging into a flange shape. At the discharging time of the paper sheet 3, undulating weak streams are formed on the paper sheet 3 in the conveying direction by those corrugated rollers 33 thereby to uncurl the paper sheet 3 and to give the paper sheet 3 the so-called "stiffness".

On the downstream side (or the front side) of the discharge port 28, there is disposed a holding member 35. This holding member 35 is integrally formed in its entirety of an electrically conductive synthetic resin so that electricity stored in the paper sheet 3 is removed, when it abuts against the paper sheet 3. Moreover, the holding member 35 has a rigidity such that it is not deformed by the stress coming from the paper sheet 3.

The holding member 35 has a shaft member 36 of an elongated rod shape, which is transversely supported at a portion obliquely in front of and above the discharge port 28 so that the holding member 35 can turn in its entirety on the shaft member 36. Radially of the shaft member 36, there are extended three extensions 37, which are juxtaposed axially at a spacing, as shown in FIGS. 3 and 4. In a natural position of the holding member 35 when the paper sheet 3 is out of abutment, the extensions 37 depend obliquely forward and downward, as shown by solid lines in FIG. 2. When the paper sheet 3 comes into abutment, the holding member 35 can turn upward from the natural position. Moreover, the shaft member 36 is equipped at its one end portion with a flat shielding plate 38, which extends downward in the natural position, as shown in FIG. 3. On the side of the body casing 2, on the other hand, there is disposed a photo-sensor 39 acting as detection means. When the holding member 35 is at the natural position, the shielding plate 38 is set to shield (not-shown) light projecting-receiving elements belonging to the photo-sensor 39. This photo-sensor 39 is configured to output a paper detection signal to the (not-shown) control means when the shielding plate 38 is not positioned to shield the light projecting-receiving elements.

The actions at the time of discharging the paper sheet 3 are described as follows. When the paper sheet 3 is discharged by the discharge roller pair 27, the extensions 37 are raised up by the pushing force of the paper sheet 3, as indicated by double-dotted lines in FIG. 2. At this time, the electricity stored in the paper sheet 3 is removed. On the other hand, the shielding plate 38 is turned as the extensions 37 turn. As a result, the light projecting-receiving elements are opened so that the photo-sensor 39 outputs the paper detection signal. Thus, it is detected that the paper sheet 3 has been normally discharged.

As the discharge roller pair 27 rotates, the paper sheet 3 advances above the discharge tray 29 while lifting the holding member 35. When the trailing end of the paper sheet 3 comes out of the discharge roller pair 27, the extensions 37 of the holding member 35 fall by their own weights, and the paper sheet 3 is dropped on the discharge tray 29. Thus, the paper sheet 3 is stacked at a substantially fixed position on the discharge tray 29 by the guidance of the holding member 35.

If the stack of the paper sheets 3 on the discharge tray 29 is short after the paper sheet 3 was dropped by the holding member 35, the holding member 35 restores to its original natural position. As the stack of the paper sheets 3 increases, the holding member 35 does not return to the natural position. Instead, its leading end portion is held in abutment against the uppermost paper sheet 3. As the stack of the paper sheets 3 becomes taller, the shielding plate 38 does not return, after the paper sheet 3 was dropped by the holding member 35, to the position for shielding the light projecting-receiving elements. Therefore, the paper detection signal is continuously outputted from the photo-sensor 39. The continuous output of the paper detection signal for a predetermined or longer time period indicates that the discharge tray 29 is fully occupied by the paper sheets 3.

According to the illustrative aspect thus far described, the holding member 35 is provided with three functions: the function to guide the paper sheet 3 onto the discharge tray 29 thereby to enhance the stackability; the function as the detection member to detect the stack of the paper sheets 3; and the function of removal of electricity from the paper sheets 3. As a result, the number of the parts can be reduced to lower the cost.

Moreover, the holding member 35 is integrally formed of the conductive material so that electricity of the paper sheet 3 can be removed by bringing it into contact with the holding member 35.

Moreover, the holding member 35 is formed of the conductive resin material so that it can be easily manufactured.

In a case where an electricity removing brush is used as the electricity removing member, on the other hand, the brush may be worn or deformed after repeated use, which degrades the electricity removing function. In this constitution, the member 35 used has a high stiffness so that it can prevent the electricity removing function from becoming lower.

<Second Illustrative Aspect>

A second illustrative aspect of the invention is described with reference to FIG. 5.

Figure 5:
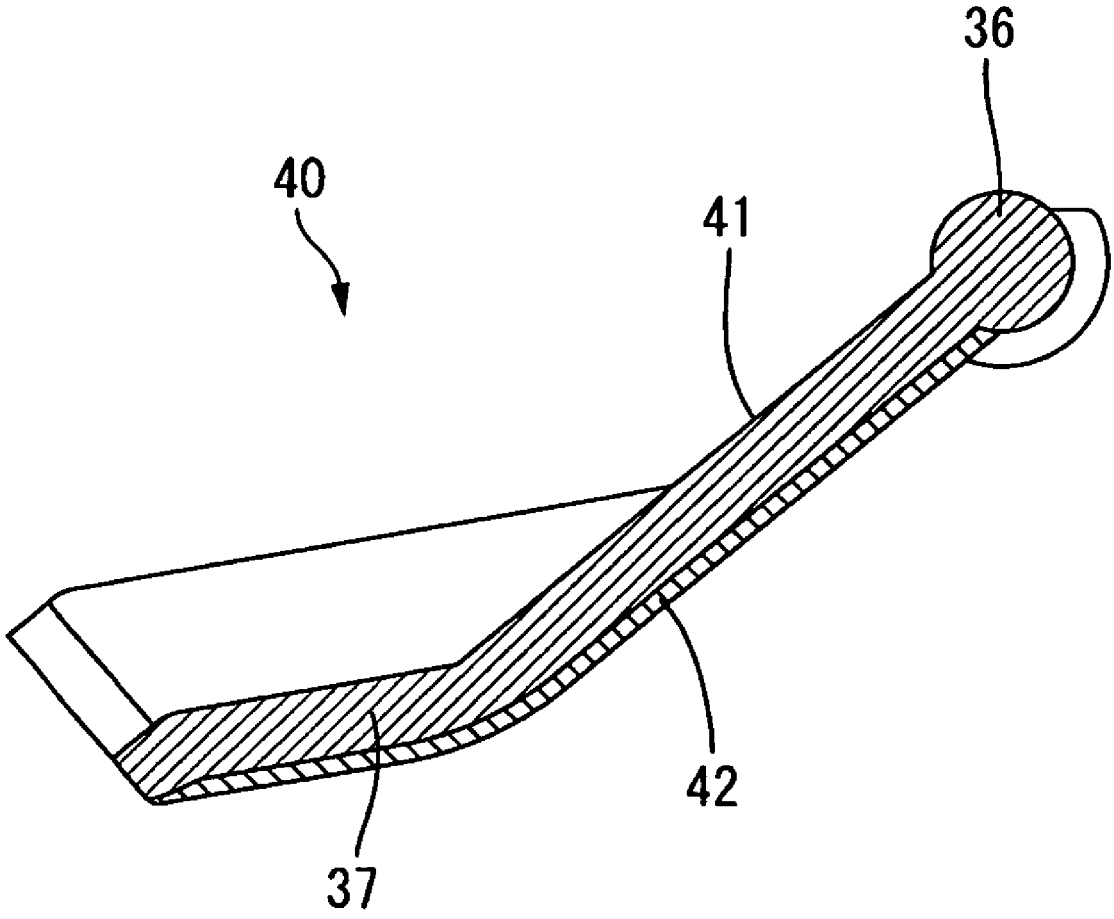
FIG. 5 is a sectional side view of a sheet retainer according to a second illustrative aspect.

FIG. 5 is a sectional side view of a holding member of this illustrative aspect. In the following description, the description of the components like those of the first illustrative aspect is omitted by designating them by the common reference numerals.

A holding member 40 of this illustrative aspect is equipped with a root portion 41, which has a base member 41 acting as a base material having a shape substantially similar to the holding member 35 of the first illustrative aspect. This base member 41 is integrally formed of an insulating synthetic resin material. Moreover, a conductive electricity removing sheet 42 is adhered to the lower face of the extensions 37 of the holding member 40, i.e., such an area of the surface of the base member 41 as can abut against the paper sheet 3. This electricity removing sheet 42 is made of a conductive member of a thin film shape such as a copper foil, and removes the electricity, as might otherwise be stored in the paper sheet 3, when the paper sheet 3 discharged from the discharge port 28 comes into abutment.

According to this illustrative aspect, the holding member 40 is constituted by adhering a conductive film-shaped member to the surface of the base member 41 made of the insulating synthetic resin material in order to reduce the cost for the material.

<Another Illustrative Aspect>

The invention should not be limited to the illustrative aspects thus far described in the foregoing description and with reference to the accompanying drawings, but the following illustrative aspect is also contained in the technical range of the invention. In addition to the following illustrative aspect, the invention can be practiced in various manners without departing from the gist thereof. (1) The sheet retainer may be constituted to perform a self-discharge or to be grounded to the earth, if it can remove the electricity of the sheet.

What is claimed is:

1. An image forming apparatus comprising:

a discharge tray, on which a sheet discharged from a discharge port is stacked;

a sheet retainer, which guides the sheet discharged from the discharge port onto the discharge tray, and which is displaced in abutment against an uppermost sheet stacked on the discharge tray, the sheet retainer removing electricity of the sheet; and a detection unit, which comprises a photo-sensor, and which detects a stack of the sheet on the discharge tray on a basis of a position of the sheet retainer, wherein the sheet retainer comprises:

a shaft member;

extensions, which are disposed integrally on the shaft member, which extend from the shaft member, and which contact the sheet; and a shielding plate, which is disposed at one end portion of the shaft member, and which turns in accordance with the extensions to open or shield the photo-sensor wherein each of the extensions comprises a single rigid piece, which is formed of a conductive material, which is configured to remove electricity from the sheet, and which has a stiffness, so that the single rigid piece is not deformed by a pressure received from the sheet.

2. The image forming apparatus according to claim 1, wherein the sheet retainer is formed of a conductive material.

3. The image forming apparatus according to claim 2, wherein the sheet retainer is formed of a conductive resin material.

4. The image forming apparatus according to claim 1, wherein the sheet retainer comprises:

a base member; and a conductive film disposed on the base member.

5. The image forming apparatus according to claim 1, wherein the sheet retainer is made of a member having a stiffness so that the sheet retainer is not deformed by a pressure to be received from the sheet.

6. The image forming apparatus according to claim 1, wherein each of the extensions has a bending form.

7. An image forming apparatus comprising:

a discharge tray, on which a sheet discharged from a discharge port is stacked;

a sheet retainer comprising extensions, which guide the sheet discharged from the discharge port onto the discharge tray, which are disposed in abutment against an uppermost sheet stacked on the discharge tray, and which remove electricity of the sheet; and a detection unit, which detects a stack of the sheet on the discharge tray on a basis of a position of the sheet retainer, wherein each of the extensions comprises a single rigid piece, which is formed of a conductive material, which is configured to remove electricity from the sheet, and which has a stiffness, so that the single rigid piece is not deformed by a pressure received from the sheet.

* * * * *